US011491815B2

(12) United States Patent
Rosset

(10) Patent No.: US 11,491,815 B2
(45) Date of Patent: Nov. 8, 2022

(54) SECURITY PAPER

(71) Applicant: OBERTHUR FIDUCIAIRE SAS, Paris (FR)

(72) Inventor: Henri Rosset, Le Pin (FR)

(73) Assignee: OBERTHUR FIDUCIAIRE SAS, Paris (FR)

( * ) Notice: Subject to any disclaimer, the term of this patent is extended or adjusted under 35 U.S.C. 154(b) by 0 days.

(21) Appl. No.: 17/048,796

(22) PCT Filed: Apr. 17, 2019

(86) PCT No.: PCT/EP2019/059912
§ 371 (c)(1),
(2) Date: Oct. 19, 2020

(87) PCT Pub. No.: WO2019/206760
PCT Pub. Date: Oct. 31, 2019

(65) Prior Publication Data

US 2021/0146712 A1 May 20, 2021

(30) Foreign Application Priority Data

Apr. 23, 2018 (FR) ..... 1853542

(51) Int. Cl.
*B42D 25/333* (2014.01)
*B42D 25/351* (2014.01)
(Continued)

(52) U.S. Cl.
CPC ..... *B42D 25/333* (2014.10); *B42D 25/328* (2014.10); *B42D 25/346* (2014.10);
(Continued)

(58) Field of Classification Search
CPC ..... B42D 25/333; B42D 25/351
See application file for complete search history.

(56) References Cited

U.S. PATENT DOCUMENTS 5,961,432 A * 10/1999 Murakami ..... D21F 1/44 493/187
8,465,625 B2 * 6/2013 Boehm ..... D21F 1/44 162/211
(Continued)

FOREIGN PATENT DOCUMENTS

DE 102005022018 A1 11/2006
DE 102014016249 A1 * 5/2016 ..... B41M 3/14
(Continued)

OTHER PUBLICATIONS

WO-2015197617-A1 English Translation (Year: 2015).*
(Continued)

*Primary Examiner* — Kyle R Grabowski
(74) *Attorney, Agent, or Firm* — Shumaker, Loop & Kendrick, LLP

(57) ABSTRACT

A security sheet including at least one paper substrate, at least one watermark produced in the paper substrate, the watermark having an exterior outline, at least one aperture of regular edge, produced by ablation of the paper substrate, and at least one security film that is at least partially superposed on the watermark and on the aperture. In the sheet, the at least one aperture lies inside the watermark, such as bounded by its exterior outline.

29 Claims, 5 Drawing Sheets

(51) Int. Cl.

| | |
|---|---|
| ***B42D 25/328*** | (2014.01) |
| ***B42D 25/346*** | (2014.01) |
| ***B42D 25/355*** | (2014.01) |
| ***B42D 25/373*** | (2014.01) |
| ***B42D 25/435*** | (2014.01) |
| ***B42D 25/44*** | (2014.01) |

(52) U.S. Cl.
CPC ..... *B42D 25/351* (2014.10); *B42D 25/355* (2014.10); *B42D 25/373* (2014.10); *B42D 25/435* (2014.10); *B42D 25/44* (2014.10)

(56) References Cited

U.S. PATENT DOCUMENTS

| | | | | |
|---|---|---|---|---|
| 2007/0194934 | A1* | 8/2007 | Tauber | B42D 25/346 340/572.8 |
| 2008/0216976 | A1* | 9/2008 | Ruck | B42D 25/29 162/110 |
| 2017/0225503 | A1* | 8/2017 | McLean Henderson | B42D 25/355 |

FOREIGN PATENT DOCUMENTS

| | | | | |
|---|---|---|---|---|
| DE | 102014016249 | A1 | 5/2016 | |
| DE | 102015000690 | A1 * | 7/2016 | B42D 25/333 |
| EP | 0319157 | A | 6/1989 | |
| WO | 200510618 | A2 | 2/2005 | |
| WO | 2014199296 | A1 | 12/2014 | |
| WO | WO-2015197617 | A1 * | 12/2015 | B42D 25/355 |
| WO | WO-2016116256 | A1 * | 7/2016 | B42D 25/333 |
| WO | 2014119296 | A1 | 1/2017 | |

OTHER PUBLICATIONS

WO-2016116256-A1 English Translation (Year: 2016).*
DE-102015000690-A1 English Translation (Year: 2015).*
DE-102014016249-A1 English Translation (Year: 2014).*
International Search Report (ISR) for PCT/EP2019/059912 dated Jul. 5, 2019 with English Translation (6 pages).

* cited by examiner

SECURITY PAPER

TECHNICAL FIELD AND BACKGROUND

The present invention relates to a security sheet, especially one intended for the production of a security document.

By "security document" what is meant is a means of payment, such as a banknote, a check or a meal voucher, an identity document, such as an identity card, a visa, a passport or a driving license, a lottery ticket, a travel ticket or even a ticket for entry to a cultural or sporting event.

The invention more particularly but not exclusively relates to security sheets intended for the production of banknotes.

In order to guard against attempts to falsify or counterfeit a security document, it is desirable for the document to be able to be authenticated and/or identified simply.

The technique of watermarking is very commonly used in the field of security papers and in particular in the field of paper money, for which watermarking remains the conventional way of achieving a level-one security marking that is identifiable and locatable by most banknote users, even the man in the street.

It has already been proposed, in patent application WO2005/106118, to produce a security sheet comprising a paper substrate provided with a watermark, with apertures covered by a security film affixed to one face of the substrate. The apertures are produced outside the watermark, and visually complement the appearance thereof. The security film may include de-metallizations that participate in the overall observable pattern.

U.S. Pat. No. 8,465,625 discloses an aperture produced using a paper-making process, having an irregular edge with fibers that protrude into the aperture in a way visible to the naked eye. This aperture may contribute to forming an overall pattern in combination with a watermark placed therearound. The aperture may be covered by a film added to one face of the paper substrate. The production of such an aperture of irregular edge is a paper-making operation that is complex to master, which makes the obtainment of detailed, reproducible and esthetic effects relatively more difficult.

Patent DE102005022018 discloses a security document comprising two apertures, one of regular edge and the other of irregular edge. The aperture of regular edge may be incorporated in a watermark.

Patent DE102014016249 discloses a security document comprising a through-aperture that may be combined with a security thread or a watermark, the aperture being cut by laser.

SUMMARY

The invention aims to further improve security sheets, and in particular to provide a security marking that is easily recognizable by the man in the street and that enables many esthetic possibilities, while being complex for a counterfeiter to reproduce.

The invention achieves this objective by providing, according to a first of its aspects, a security sheet comprising:

- at least one paper substrate,
- at least one watermark produced in the paper substrate, this watermark having an exterior outline,
- at least one aperture of regular edge, produced by ablation of the paper substrate,

- at least one security film that is at least partially superposed on the watermark and on the aperture, the sheet being characterized in that said at least one aperture lies inside the watermark, such as bounded by its exterior outline.

By "inside the watermark" what is meant is the connected area bounded by a curve following the outermost outline of the watermark. Thus, a watermark of circular ring shape will define a connected area of disk shape of outside diameter equal to that of the ring.

The aperture may lie inside the watermark and be or not be superposed on a watermarked region, i.e. on the watermark itself. Returning to the example of an annular watermark, the aperture may be inside the watermark without being superposed thereon if the aperture is a hole of diameter smaller than that of the interior circle of the ring. The watermarked region is the region the thickness of which is different from the thickness of the unwatermarked paper. This thickness may be smaller than that of the unwatermarked paper for a light watermark, and larger for a dark watermark.

The outline of the watermark is the outline that exists before the cut-out is produced.

The cut-out may or may not be produced through a watermarked region. When the cut-out is produced through a watermarked region, this means that one portion of the watermark is removed by the cutting operation.

Producing the one or more apertures inside the watermark makes it possible to make any manufacturing-tolerance-related offset between the expected position of the aperture and the expected position of the watermark more acceptable from an esthetic point of view.

In addition, the watermark has a variable paper thickness and producing a cut-out of regular edge within it requires a high-performance cutting tool, thus making counterfeiting more difficult.

The aperture may have various areas, possibly smaller than 1 $mm^2$ or larger than 1 $mm^2$, and for example extend right up to the exterior outline of the watermark in which it is produced.

By "regular edge", what must be understood is an edge without long free fibers that protrude in a manner visible to the naked eye into the aperture, contrary to the aperture (obtained using a paper-making process) disclosed in the aforementioned patent U.S. Pat. No. 8,465,625. The regular edge is preferably an edge obtained by laser cutting, and this edge may be straight, curved, wavy or indented, the waves or indents being produced by cutting.

Yet another subject of the invention, according to a second of its aspects, is a security sheet comprising:

- at least one paper substrate,
- at least one representation of a reference pattern, especially taking the form of a print, of a metallization/demetallization or of a hologram,
- at least one watermark produced in the paper substrate, this watermark representing said reference pattern in an incomplete form,
- at least one aperture of regular edge, produced by ablation of the paper substrate, this aperture completing the watermark and reproducing therewith the appearance and/or meaning of the reference pattern when the sheet is observed in transmitted light,
- at least one security film that is at least partially transparent or translucent, this film being at least partially superposed on the aperture.

Preferably, the security document is a banknote.

Preferably, the security film comprises a plastic carrier.

The region of the sheet in which the aperture is superposed on the security film is referred to as a "window".

The invention, according to its first and second aspects, allows the security of the document with respect to the risk of counterfeiting to be further increased by proposing a combination allowing the united watermark and security film to be observed synchronously, either in transmitted light, or in reflected light.

The security element may have, in the region of the aperture, front and back faces of different appearances. It may in particular be a question of a difference in glossiness, in contrast, in color and/or hue, of patterns of different size, outline and/or content, and/or of different patterns. This difference in appearance is observable in transmitted or reflected light, and preferably in reflected light. The difference is then observable from the front at at least one given angle of observation, and from the back at at least one given angle of observation. It may be observable when the front is illuminated with at least one type of illumination, especially visible, UV or IR light, and when the back is illuminated with at least one type of illumination, especially visible, UV or IR light.

Preferably, the front and back faces comprise different patterns. In this manner, the observations may differ because of an asymmetry in the appearance of the front and back faces.

This combination advantageously makes it possible to mitigate the lack of visibility of the window when the associated patterns are too crowded, especially by the print, to be immediately noticeable by the man in the street. Specifically, it is common to not crowd the print near the watermark, and in particular to deprive the watermarked region of print.

The combination of the security film with the watermark, the observation of which in transmitted light is spontaneously more natural, allows the window to be noticed more easily.

Moreover, especially when the esthetics of the patterns of and optical effects generated by the window are tantalizing and easily seen, the observer is incited to pay more attention to the watermark and this becomes an indirect way of increasing the amount of attention that he pays to its authenticity.

Another of the advantages achievable via the invention is durable protection of the watermark by the security film, which protection may be partial or complete depending on to what extent the watermark and film overlap and depending on whether or not another protective film, affixed on the opposite side of the paper substrate, and called the "counterfoil", is present.

Various optical effects may be obtained, especially in the window.

Effects such as patterns that appear as negative writing in transmitted light, especially such as described in patent application EP0319157 (these effects being referred to as CLEARTEXT effects) may be obtained.

The optical effect present in the window will possibly be united, with CLEARTEXT effects visible in transmitted light, and exhibit in reflected light patterns and/or optical effects and/or colors that are different on each of the faces.

As a variant, the security film may advantageously leave, level with the aperture, a transparent area exempt of visible optical effect.

The extent of the watermark such as bounded by its exterior outline may be greater than the extent of said at least one aperture by a factor at least equal to 1.1, better still at least equal to 1.5, and even better still by a factor at least equal to 10 or 20.

The aperture may be small in size, and in particular be a micro-perforation. By "micro-perforation", what is meant is an aperture the extent of which is less than or equal to 1 $mm^2$.

Said at least one aperture may be arranged at the center of the watermark or elsewhere. A central arrangement may further increase security, since precise positioning is required to achieve it.

Preferably, the aperture is positioned, with respect to a nominal position on the security document, with a precision better than +/−3 mm in the machine direction MD (i.e. in the direction in which the substrate passes through the paper-making machine) and in the transverse direction TD. Where appropriate, the offset, which is measured between the expected position of the aperture with respect to the watermark and the observed position, is measured, and it is checked whether this offset respects a predefined statistical relationship. If it does, this may be an additional indication of the authenticity of the document.

The security film preferably comprises at least one security element that is at least partially superposed on the aperture. Preferably, the security film entirely covers the aperture. The security element may or may not entirely cover the aperture. The security element may be an optically variable device, and especially a diffractive device.

The outline of the security element may be homothetic with that of the aperture, or as a variant be of any type. A homothetic outline may further increase security, being more difficult to produce. It may also make the detection of a security element that is poorly positioned with respect to the outline of the aperture easier.

The security film and the security element may entirely cover the aperture, and especially be of extent greater by 5 to 20% with respect to the extent of the aperture.

The security element may be optically variable in the region of the aperture. It is for example a question of an optically variable device (OVD) such as a lenticular security element, a security element based on a Moiré effect, a security element that is diffractive and especially of first order (laser hologram, 3D hologram, blazed grating) or of zeroth order, or a security element such as a thin-film interference structure, especially a monolayer or multilayer interference structure (Bragg structures, volume holograms, liquid crystals, etc.). Such a device produces different visual effects, when the angle of observation or of illumination varies.

The security element may be a diffractive structure, and in particular a diffractive optical element such as a DOE digital hologram, such as described in patent application WO 2014/119296 on page 5. When such an optical element is illuminated, especially by a collimated beam, it generates an interference pattern that produces an image in a viewing plane, which is visible in an area positioned in this plane, or visible in transmission from this plane. Such a diffractive optical element is generated by computer, and differs from so-called rainbow, Fresnel or volume-reflection holograms.

The security element may comprise, in the region of the aperture, a metal layer and at least one void therein.

The outline of said at least one aperture may be substantially homothetic with that of the watermark.

The outline of said at least one aperture may be homothetic with a pattern of the watermark.

The watermark may be stippled and/or shaded, inter alia, and for example be an electrotype watermark.

Preferably, as mentioned above, the film entirely covers said at least one aperture.

The film may extend in a strip from one edge to the opposite edge of the sheet. As a variant, the film is applied in the form of a patch that covers the aperture and more, and that may thus be superposed on the watermark. When the film is a patch, it is set back from at least three edges of the document, when the latter is of rectangular shape, and better still set back from all the edges of the document.

The width of the film may be smaller than that of the watermark.

The outline of said at least one aperture may be reproduced elsewhere on the sheet or on the security element. This allows security to be increased, by making reproduction of the security sheet more difficult.

Said at least one window may make contact with a watermarked region of thickness different from the thickness of the unwatermarked sheet, and especially with a region of smaller thickness. This may minimize the creation of additional thickness.

The watermark may be without center of symmetry.

Yet another subject of the invention is a process for manufacturing a security sheet, comprising steps consisting in producing a watermarked sheet of paper comprising at least one watermark, in cutting at least one aperture in this watermark and in at least partially, and better still entirely, obturating said aperture with a security film that also covers the watermark.

The aperture is preferably produced using a laser, but as a variant it may be produced using a die-cutter.

When the aperture is produced with a laser, the method may comprise an optical acquisition of the region of the watermark, and control in real time of the laser depending on this acquisition, so as to direct the laser with respect to the frame of reference of the watermark, in order to guarantee a predefined position of the aperture within the watermark. This allows the appearance of the combined pattern formed by the watermark and the aperture to be kept substantially constant, while allowing for the dispersion in the watermark's position within the sheet as a result of the papermaking process.

The reference pattern may be present on the security film, especially in the form of a print, of a metallization or of a de-metallization, and preferably in the form of a partial de-metallization after metallization ("metallization/de-metallization" below).

The watermark may comprise a plurality of repeating elementary patterns and said at least one aperture may have the same outline as one of said elementary patterns.

As indicated above, the watermark may be of any type, for example being a shaded and/or stippled watermark. The reference pattern may be alphanumeric. In this case especially, the watermark may be an electrotype watermark.

The film may be at least partially superposed on the watermark.

The film may extend beyond the watermark.

The watermark may be sandwiched between two films added to either side thereof, on the front and back faces of the paper substrate. These films may or may not cover the same area of the paper substrate, and may or may not superpose exactly. Where appropriate, at least one of these films covers the surface of the paper substrate in its entirety. In one example, each of these films covers the surface of the paper substrate in its entirety.

Yet another subject of the invention, according to another of its aspects, is a security document, especially a banknote, comprising a security sheet according to the invention, such as defined above.

The security sheet, or the document obtained therefrom, and especially the banknote, may comprise one or more additional security elements such as defined below.

Among these additional security elements, certain are detectable by eye, under daylight or artificial light, without use of any particular equipment. These security elements for example comprise colored flakes or fibers or partially or completely metallized or printed threads. These security elements are said to be level-one security elements.

Other types of additional security elements are detectable only using a relatively simple piece of equipment, such as a lamp emitting in the ultraviolet (UV) or in the infrared (IR). These security elements for example comprise fibers, flakes, strips, threads or particles. These security elements may or may not be visible to the naked eye, being for example luminescent when illuminated by a Wood's lamp emitting at a wavelength of 365 nm. These security elements are said to be level-two security elements.

To be detected, other types of additional security elements require a more sophisticated piece of detection equipment. These security elements are for example capable of generating a specific signal when they are subjected, whether simultaneously or not, to one or more exterior exciting sources. The automatic detection of the signal allows, where appropriate, the document to be authenticated. These security elements for example comprise tracers taking the form of active materials, particles or fibers capable of generating a specific signal when these tracers are subjected to an optronic, electric, magnetic or electromagnetic excitation. These security elements are said to be level-three security elements.

The one or more additional security elements present on and/or within the security sheet, and especially the security film and/or paper substrate, may have security features of level one, two or three.

Yet another subject of the invention, according to another of its aspects, is a method for authenticating a security sheet or a security document such as defined above, wherein at least one face of the sheet is observed in reflected light and in transmitted light, and information regarding the authenticity of the document is generated on the basis of this observation. The front and back faces may especially each be observed in reflected light and in transmitted light and said information may especially be generated on the basis of this observation. The observation may be through the window. An overall pattern formed by the watermark, the one or more apertures and at least one element of the security film may be compared with a reference pattern featuring elsewhere on the sheet or the document, this reference pattern for example being printed, formed by metallization and/or de-metallization or by a hologram.

BRIEF DESCRIPTION OF THE DRAWINGS

The invention will possibly be better understood on reading the detailed description that follows, of non-limiting examples of implementation thereof, as well as on examining the appended drawing, in which.

DETAILED DESCRIPTION

Figure 1:
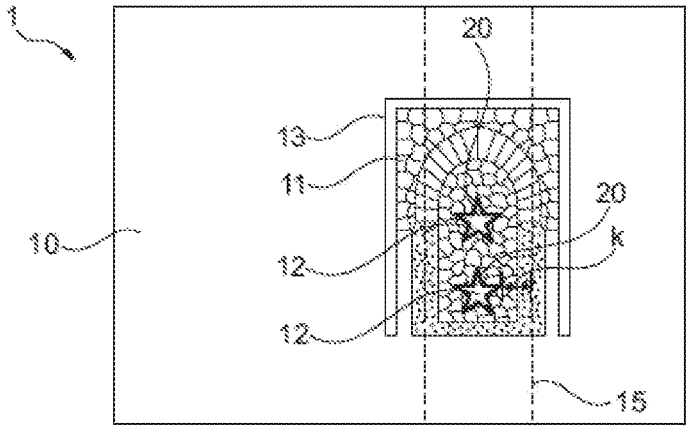
FIG. 1 shows an example of a security document according to the invention, observed from the back side.
Figure 2:
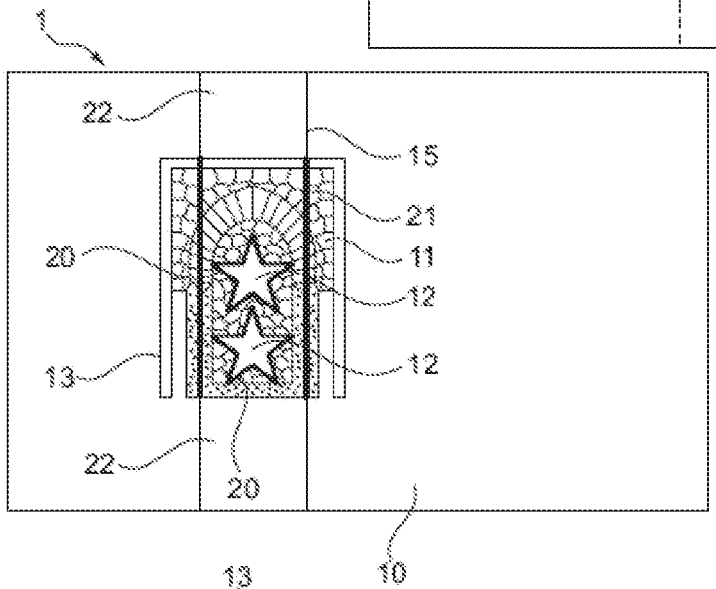
FIG. 2 shows the document of FIG. 1, observed from the front side.

FIGS. 1 and 2 show a first example of a security document 1 produced according to the invention.

This document 1 is for example a banknote, and may have a rectangular shape.

The document 1 comprises a paper substrate 10 having a watermark 11, which may be of any type.

Figure 3A:
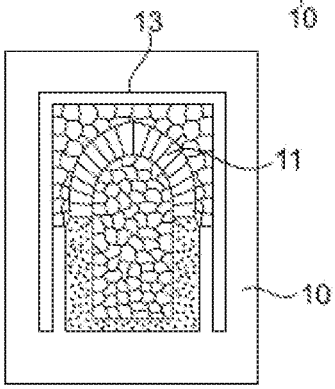
FIG. 3A shows the watermark of the document of FIGS. 1 and 2 during the production of the security sheet, before the apertures have been produced.

This watermark 11 is shown in isolation in FIG. 3A, with the appearance that it may have after the manufacture of the paper substrate 10.

According to one aspect of the invention, the document 1 comprises at least one aperture 12 formed in the substrate 11.

This aperture 12 is preferably produced by cutting with a laser, this allowing a cut with a regular edge to be obtained.

Figure 3B:
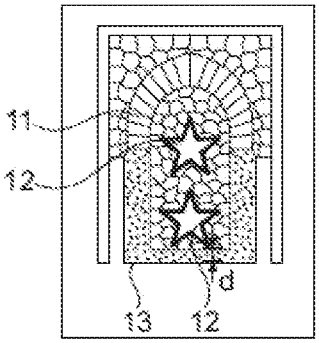
FIG. 3B shows the watermark of FIG. 3A after the apertures have been produced.

In the example in question, two apertures 12 each of star shape are thus produced through the watermark 11, during the manufacture of the document 1, as illustrated in FIG. 3B.

These apertures 12 are set back from the exterior outline 13 of the watermark 11, being for example at a non-zero minimum distance d from this outline of, for example, larger than or equal to 3 mm.

To produce the one or more apertures 12, the laser cutting machine may comprise an optical device for locating the watermark on the paper substrate, so as to use this watermark as a spatial reference when producing the one or more apertures. This allows tolerances in the position of the watermark on the sheet plane, which are unavoidable because of the manufacturing process of the latter, to be allowed for. The optical device for example comprises at least one camera that films the sheet and a computer for analyzing the image and recognizing the watermark. Next, the computer may drive the laser to produce the one or more apertures in a predefined region of the watermark.

In accordance with the invention, the security document 1 also comprises at least one film 15 added to the paper substrate 10. This film 15 may, as illustrated, take the form of a strip extending from one edge of the document to the opposite edge.

The film 15 may include a carrier made of a thermoplastic such as PET for example. Preferably, the material of the carrier is transparent.

The film 15 bears at least one security element 20, taking the form of at least one pattern formed by metallization/de-metallization, for example, or as a variant by printing. In the example illustrated, the film 15 comprises two security elements 20 each taking the form of a star produced by metallization/de-metallization. The pattern of the security element 20 may correspond to the shape of the aperture, each for example being the homothetic transform of the other. In particular, the security element may have a size larger than that of the aperture 12 on which it is superposed. Thus, despite any tolerances in the position of the film 15 relative to the aperture 12, the security element 20 continues to fully obturate the aperture, as illustrated.

The film 15 comprises a transparent zone 21 in which the one or more security elements 20 are produced, the film 15 being metallized, or as a variant printed, outside this zone 21 in regions 22 not superposed on the watermark 11. The region 21 is for example formed by de-metallization of a layer of metal deposited on the film 15, for example by vacuum metallization or electrodeposition. As a variant, the region 21 may be obtained by printing. The two techniques may also coexist within the same film 15.

The film 15 is fastened to the paper substrate by an adhesive, a heat-activatable adhesive for example. It is for example applied by hot transfer.

Preferably, the film 15 is fastened after the apertures 12 have been produced.

The film 15 may have a sufficient width to allow it to completely cover the apertures 12, as illustrated. The minimum distance k between the edge of an aperture and the edge of the film 15 is preferably non-zero, in particular in order to ensure the solidity of the assembly, and for example larger than or equal to 3 mm.

The width of the film 15 for example ranges from 5 to 20 mm.

The film 15 at least partially covers the watermark. In the illustrated example, the coverage is partial, the watermark protruding from each side of the film 15.

It is useful for the film 15 to keep a certain transparency in the region 21 thereof that is superposed on the watermark 11, so as not to affect the visibility of the latter in transmitted light.

In the region of the one or more apertures 12, the film may comprise, as has just been described, a level-one security element formed by printing or by metallization/de-metallization. As a variant, the security element is diffractive and for example produced so as to form an image when illuminated by a beam of light such as a laser beam. In one variant, the film comprises, superposed on the aperture, a level-two security element.

When the security document is viewed in reflected light from the back side, as in FIG. 1, the security elements 20 may be seen through the apertures 12.

The regions 22 of the film 15 are masked by the paper substrate. The watermark 11 is faintly visible. In transmitted light, the watermark 11 becomes more visible.

When the security document 1 is observed in reflected light from the front side, it is possible to see, as illustrated in FIG. 2, the regions 22 of the film 15 and the security elements 20. The apertures 12 are masked by the security elements 20. The watermark 11 is faintly visible, but becomes more visible in transmitted light.

As variants (not illustrated), the security document 1 comprises a second film that covers the paper substrate on the side opposite the film 15. This may allow the protection of the apertures 12 to be improved.

Figure 4A:
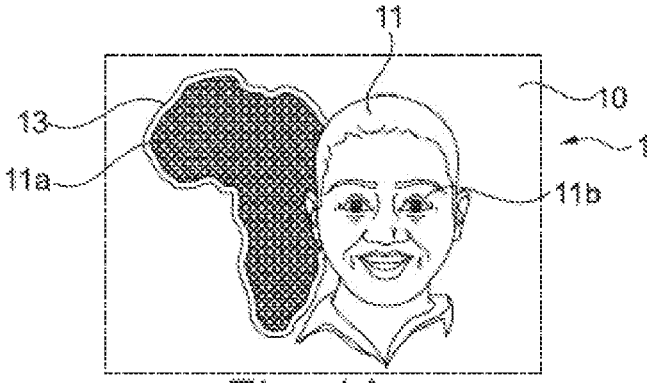
FIGS. 4A, 4B, and 4C illustrate various stages of the production of a variant security sheet according to the invention.
Figure 4B:
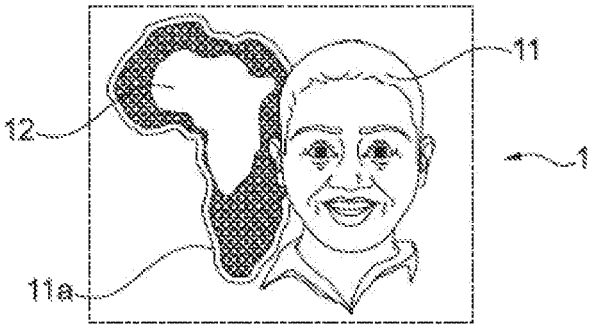
Figure 4C:
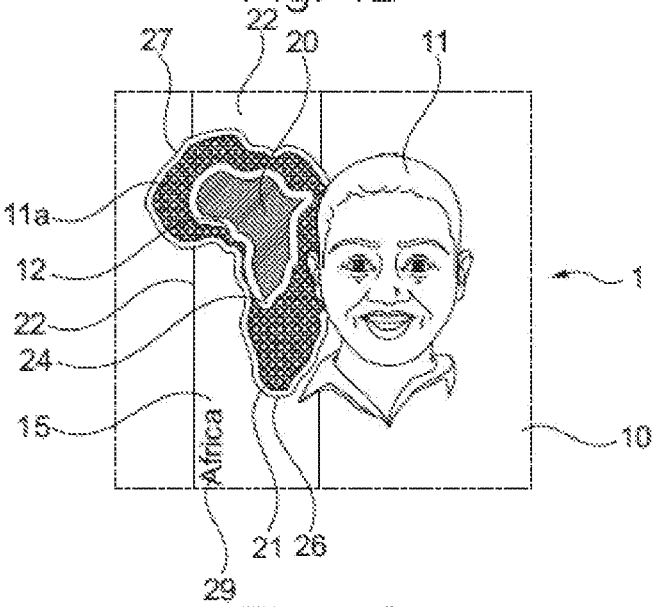

FIGS. 4A to 4C show various stages of the manufacture of a variant security document 1.

In FIG. 4A, a watermark 11 produced in the paper substrate 10 of the document may be seen. This watermark 11 is for example formed by the juxtaposition of a stippled watermark 11*a* and of a shaded watermark 11*b*.

FIG. 4B illustrates the production of an aperture 12 within this watermark 11, at a distance from the edges of the watermark 11*a*.

A security film 15 is added to the paper substrate 10, as illustrated in FIG. 4C. This film 15 comprises a security element 20 which is positioned on the document so as to overlap with the aperture 12 and at a distance from the edge thereof, so as to leave a margin 24 as illustrated.

The security element 20 may have a pattern, formed by metallization/de-metallization or by printing, or even by a combination of these two techniques, the outline of which has a link with that of the aperture 12, it for example being homothetic therewith as illustrated.

The security element 20 may comprise a text that appears as negative writing, for example letters as illustrated.

FIG. 4C also shows that the film 15 may have a transparent region 21 the outline 26 of which closely follows that of the watermark 11, for example while leaving an interval 27. The transparent region 21 is for example formed by de-metallization of the film 15. The regions 22 of the film 15 that are located on either side of the transparent region 21 may be opaque and for example metallized, and may contain patterns 29 forming negative writing, for example the letters of the word "Africa" in the illustrated example.

Figure 5:
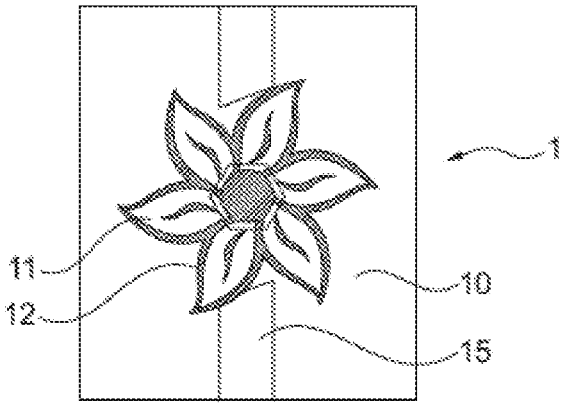
FIG. 5 shows a variant security document, observed from the back side.
Figure 6:
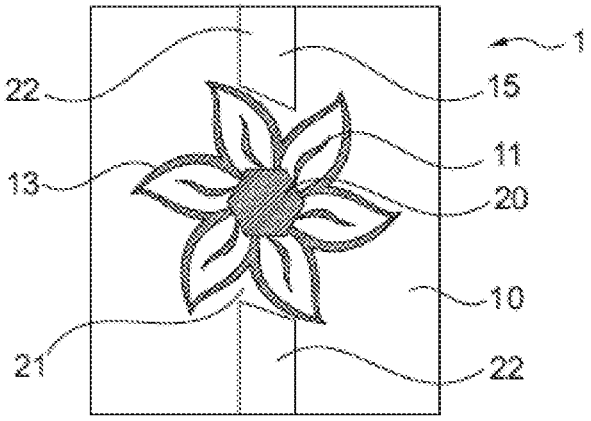
FIG. 6 shows a variant security document, observed from the front side.

FIGS. 5 and 6 show a variant security document 1 comprising a watermark 11 of flower shape.

Figure 7A:
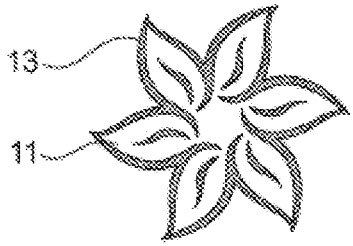
FIGS. 7A and 7B illustrate various stages of the production of the sheet of the document according to FIGS. 5 and 6.

This watermark 11 is shown in isolation in FIG. 7A.

Figure 7B:
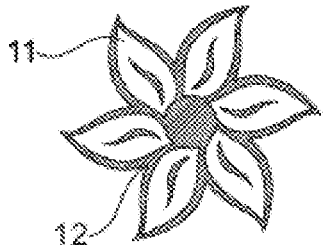

Document 1 comprises an aperture 12, for example of hexagon shape, produced in the central part of the watermark 11, as illustrated in FIG. 7B. This aperture 12 is preferably produced by laser cutting, like the previous examples.

The document 1 comprises a security film 15, which comprises, as illustrated in FIG. 6, a transparent region 21 with a security element 20 formed for example by printing or by metallization/de-metallization of the film 15. This security element 20 has, for example, an outline that is homothetic with that of the aperture 12, and is preferably of larger dimensions.

The security element 20 advantageously complements, esthetically and conceptually, the watermark 11, as may be seen in FIG. 6.

The security element 20 is visible through the aperture 12 from the back side, as shown in FIG. 5.

Figure 8:
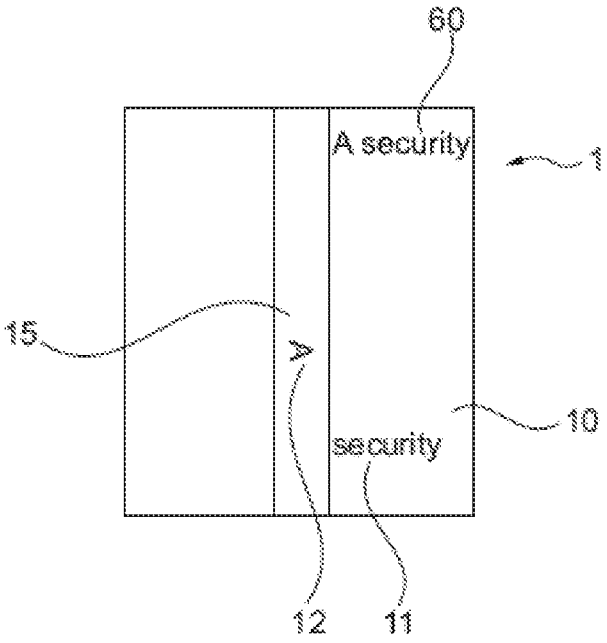
FIG. 8 shows another exemplary document according to the invention, and FIGS. 9A, 9B, 9C, and 9D respectively show a security document according to a variant of implementation of the invention, observed from the back in reflection, from the front in reflection, from the back in transmission and from the front in transmission, respectively.

FIG. 8 shows a security document 1 comprising an electrotype watermark 11, representing an alphanumeric pattern for example, for example the term "security", and an aperture 12 produced by laser, completing the pattern of the watermark 11, for example the letter "A". The watermark 11 and the aperture 12 fully reproduce a reference sign 60 which features elsewhere on the document 1, in this case "A security". A security film 15 is laminated to the paper substrate 10 and covers the aperture 12.

This film 15 may provide various optical effects to the document, such as a holographic effect, iridescent effect, metallic effect, etc. On the front side, the pattern of the aperture 12 may thus appear with the effect provided by the security film 15.

Another exemplary security document 1 produced according to one aspect of the invention will now be described with reference to FIGS. 9A to 9D.

This document 1 comprises a paper substrate 10 provided with a watermark 11 that for example represents a frangipani flower and a butterfly.

An aperture 12 is produced through the watermark 11, preferably by laser cutting. This aperture 12 completes or closely follows the outline of a portion of the pre-existing watermark 11, in this case a petal of the flower.

The document 1 includes a security film 15 which covers the watermark 11. This film 15 comprises a transparent zone 21 the outline of which closely follows to a substantial extent the shape of the watermark 11, except in the aperture 12 where the edge 30 of the transparent zone may have, as illustrated, a shape that follows that of an opposite edge 31 of the aperture 12, thus creating a transparent window 32 through the aperture 12 between edge 30 and edge 31.

The film 15 may be narrower than the watermark 11 but wider than the aperture 12, as illustrated, entirely covering the latter.

A reference pattern 35 repeating that of the watermark 11, or a portion thereof, in this case the flower, may appear on the film 15. This reference pattern 35 may be produced by de-metallization of a metallized zone of the film 15 or by a negative print on the film 15.

Figure 9A:
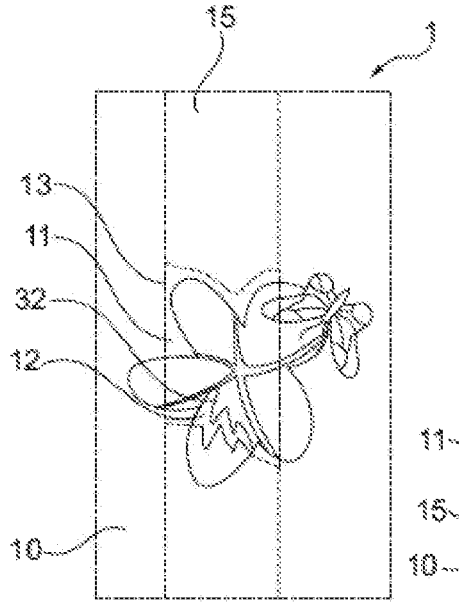

Another pattern 40, for example identically or conceptually reproducing another portion of the watermark, in this case the butterfly, may be reproduced elsewhere on the security film, for example also by de-metallization, for example on the side opposite the reference pattern 35 with respect to the watermark 11. FIG. 9A shows the document 1 as seen in reflection from the back side. The watermark 11 is faintly visible. The film 15 is masked by the paper substrate 10. The, for example metallized, zone 22 of the film 15 is visible through the aperture 12.

Figure 9B:
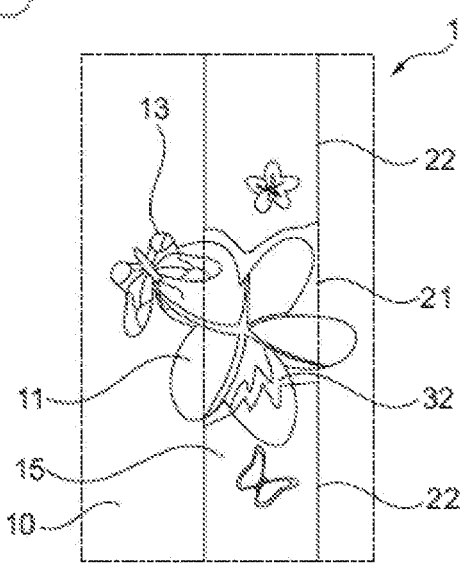
Figure 9C:
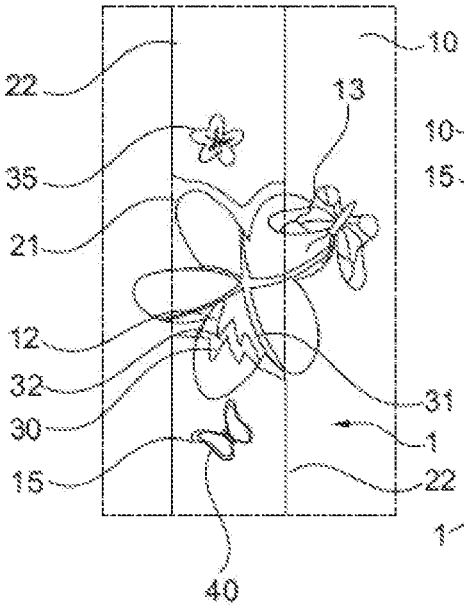

In transmitted light, as illustrated in FIG. 9C, the watermark 11 becomes clearly visible, as does the text or other patterns 35 and 40 forming negative writing produced by de-metallization of the film 15. The transparent window 32 becomes very bright.

From the front side, in reflection, as illustrated in FIG. 9B, the watermark 11 is faintly visible, as is the window 32. The film 15 is perfectly visible, and may for example exhibit a metallic reflective effect, diffractive elements or a color that varies depending on the angle of observation or of illumination.

Figure 9D:
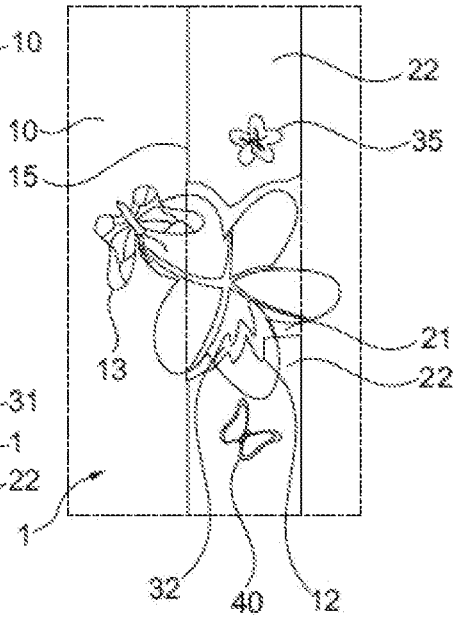

In transmitted light, as illustrated in FIG. 9D, the window 32 becomes perfectly visible, as does the watermark 11 and the text and other patterns 35 and 40 forming negative writing. The image created by the combination of the watermark and of the aperture, which forms a flower, may then be compared with the reference pattern 35; in an authentic document, the formed pattern is identical or sufficiently close in appearance to that of the reference pattern to be considered identical by the observer.

Of course, the invention is not limited to the examples that have just been described.

For example, one or more apertures of small dimensions, for example of an extent less than or equal to 1 $mm^2$, may be produced through the watermark, so as then to form one or more micro-perforations. Preferably, the security film is superposed on at least one of these micro-perforations and comprises, in the superposition region, a diffractive security element, allowing, when a beam of light, in particular a laser beam, is sent through the aperture, an image to be generated by projection. Such a diffractive security element is described in patent application WO2014/199296. As a variant, the security film is transparent in the region thereof that is superposed on the micro-perforation.

The security film may also comprise a diffractive element that is superposed on a larger aperture of the paper substrate.

The security film may comprise various security elements, which may or may not have the same appearance from the front side and back side of the film. For example, the security film comprises metallizations of different colors on its front and back faces.

The security film may comprise microreliefs produced for example by embossing the plastic carrier of the film, and these microreliefs may be metallized where appropriate.

The security film may take the form of a patch or as a variant of a film entirely covering one face of the paper substrate.

Two plastic films, at least one of which is a security film, may cover both faces of the substrate and sandwich the one or more apertures produced through the paper substrate. Where appropriate, these two films cover the entire surface of each face of the sheet.

The aperture may be given any shape, and in particular a polygonal, non-polygonal or alphanumeric shape that reproduces the shape of a pattern of the watermark or of a pattern featuring elsewhere on the document or the security film, for example a pattern printed on the paper substrate. The outline of the aperture may reproduce the shape of a country.

As a result of the presence of the watermark, the aperture and the security film, the invention allows various security devices to be brought together in a given limited region of the document, leaving more room on the document for security prints and other associated security elements.

The security film may comprise a lenticular array. This array may include microlenses that interact with micropatterns to form an image the appearance of which varies with the direction of observation.

The lenticular array may or may not be present in the region of the film superposed on the aperture. For example, the lenticular array is present on the film both in a region superposed on the aperture and elsewhere; as a variant, the lenticular array is present solely in the region of the aperture, and the associated effect may be observed through the aperture.

The one or more regions of the film bearing the lenticular array may complement the pattern of the watermark.

The expression "comprising a" must be understood with its usual meaning as being synonymous with "comprising at least one", unless otherwise specified.

The invention claimed is:

1. A security sheet, comprising:

at least one paper substrate, at least one watermark produced in the paper substrate, this watermark having an exterior outline, at least one aperture of regular edge, produced by ablation of the paper substrate, at least one security film comprising a plastic, transparent carrier, the at least one security film being at least partially superposed on the watermark and on the aperture, wherein said at least one aperture lies inside the watermark and bounded by its exterior outline, the security film comprising at least one security element that is at least partially superposed on the aperture, and wherein the security film entirely covers the aperture, and a width of the security film is smaller than a width of the watermark, the security film being transparent in the region superposed to the watermark.

2. The security sheet as claimed in claim 1, the extent of the watermark such as bounded by its exterior outline being greater than the extent of said at least one aperture by a factor at least equal to 1.1.

3. The security sheet as claimed in claim 1, said at least one aperture being placed at the center of the watermark.

4. The sheet as claimed in claim 1, the security element entirely covering the aperture.

5. The sheet as claimed in claim 1, the security element being optically variable in the region of the aperture.

6. The sheet as claimed in claim 1, the security element being an optically variable device.

7. The sheet as claimed in claim 1, the security element comprising, in the region of the aperture, a metal layer and at least one void therein.

8. The sheet as claimed in claim 1, the security element having, in the region of the aperture, front and back faces of different appearances.

9. The sheet as claimed in claim 1, the outline of said at least one aperture being substantially homothetic with that of the watermark.

10. The sheet as claimed in claim 1, the outline of said at least one aperture being homothetic with a pattern of the watermark.

11. The sheet as claimed in claim 1, the watermark being stippled.

12. The sheet as claimed in claim 1, the watermark being shaded.

13. The sheet as claimed in claim 1, the film extending in a strip from one edge to the opposite edge of the sheet or being applied in the form of a patch that covers the aperture and more.

14. The sheet as claimed in claim 1, the outline of said at least one aperture being reproduced elsewhere on the sheet or on the security element.

15. The sheet as claimed in claim 1, said at least one aperture making contact with a watermarked region of thickness different from the thickness of the unwatermarked sheet.

16. The sheet as claimed in claim 1, the watermark being without center of symmetry.

17. The sheet as claimed in claim 1, the watermark being sandwiched between two plastic films.

18. A security document, comprising a sheet such as defined in claim 1.

19. A process for manufacturing a sheet as claimed in claim 1, comprising steps consisting in producing a watermarked sheet of paper comprising at least one watermark, in cutting at least one aperture in this watermark and in at least partially obturating said aperture with a security film that also covers the watermark.

20. The process as claimed in claim 19, the aperture being produced using a laser or a die-cutter.

21. A security sheet, comprising:

at least one paper substrate, at least one representation of a reference pattern, formed as a metallization/de-metallization, and having an outline, at least one watermark produced in the paper substrate, this watermark having an outline representing said outline of the reference pattern in an incomplete form, at least one aperture of regular edge, produced by ablation of the paper substrate, this aperture completing the outline of the watermark so that the outline created by the combination of the outline of the watermark and the regular edge of the aperture is identical to the outline of the reference pattern, when the sheet is observed in transmitted light, at least one security film that is at least partially transparent or translucent, this film being at least partially superposed on the aperture and this security film being transparent in the region superposed to the watermark.

22. The sheet as claimed in claim 21, the reference pattern being present on the security film.

23. The sheet as claimed in claim 21, the reference pattern being present in the form of a de-metallization.

24. The sheet as claimed in claim 21, the watermark comprising a plurality of repeating elementary patterns and said at least one aperture having the same outline as one of said elementary patterns.

25. The sheet as claimed in claim 24, the watermark being a shaded and/or stippled watermark.

26. The sheet as claimed in claim 21, the reference pattern being alphanumeric.

27. The sheet as claimed in claim 26, the watermark being an electrotype watermark.

28. The sheet as claimed in claim 21, the film being at least partially superposed on the watermark.

29. The sheet as claimed in claim 21, the film extending beyond the watermark.

* * * * *